United States Patent [19]

Fishman

[11] Patent Number: 4,783,249

[45] Date of Patent: Nov. 8, 1988

[54] ELECTROPLATING APPARATUS WITH SELF-CONTAINED RINSE WATER TREATMENT

[75] Inventor: Herbert Fishman, Farmington, Conn.

[73] Assignee: Napco, Inc., Terryville, Conn.

[21] Appl. No.: 67,638

[22] Filed: Jun. 26, 1987

[51] Int. Cl.[4] ..... C25D 21/22; C25B 15/08

[52] U.S. Cl. ..... 204/237; 204/DIG. 13; 210/685; 210/688

[58] Field of Search ..... 204/275, 237, DIG. 13, 204/271, 273, 234, 232; 210/684, 685, 688

[56] References Cited

U.S. PATENT DOCUMENTS

| | | | |
|---|---|---|---|
| 2,279,580 | 4/1942 | Miner | 204/234 |
| 3,542,651 | 11/1970 | Yagishita | 204/237 |
| 3,658,470 | 4/1972 | Zievers et al. | 204/DIG. 13 |
| 3,681,210 | 8/1972 | Zievers et al. | 204/DIG. 13 |
| 3,905,827 | 9/1975 | Goffredo et al. | 210/688 |
| 4,219,390 | 8/1980 | Stuart et al. | 204/DIG. 13 |
| 4,303,512 | 12/1981 | Inacker et al. | 210/93 |
| 4,400,279 | 8/1983 | Wahl et al. | 210/679 |
| 4,652,352 | 3/1987 | Saieva | 204/275 |

*Primary Examiner*—Donald R. Valentine

*Attorney, Agent, or Firm*—McCormick, Paulding & Huber

[57] ABSTRACT

The continuous flow of fresh water to and metal hydroxide contaminated water from a counter flow rinse tank in an electroplating apparatus is greatly reduced or eliminated by a parallel flow path provided to an adjacent ion exchange treatment unit and from the ion exchange unit back to the rinse tank. The rinse tank is fitted with a submerged pump to provide the rinse water to the ion exchange unit and through this unit back to the rinse tank.

3 Claims, 1 Drawing Sheet

ELECTROPLATING APPARATUS WITH SELF-CONTAINED RINSE WATER TREATMENT

This invention relates generally to electroplating apparatus, and deals more particularly with a rinse water tank or counter flow series of tanks downstream of a heavy metal plating station.

Conventional electroplating apparatus generally include one or more process tanks which contain plating solutions and also include one or more water rinse tanks downstream of these plating tanks. Conventional rinse tanks or stations are provided adjacent to these plating process tanks and generally include at least one tank with an overflow weir and an outlet. Fresh water is provided to rinse away solution carried by the parts from the plating or process tank. In a single station rinse water enters through a pipe or distribution sparger near the tank bottom and flows up to and then over the weir into an outlet. The water must then be treated in a Pollution Abatement Treatment System to satisfy present day Environmental Control Laws and Regulations. In a counterflow rinse tank two or more rinse tank compartments are arranged with a partition or barrier between each compartment and the water flows oppositely to the path of the parts being rinsed in the successive compartments. More particularly the water from one of two adjacent tank compartments passes over a second weir to be discharged through a pipe or distribution sparger at the bottom of the second compartment. Such a system requires great amounts of fresh water that is generally recovered, if at all, only at great expense in a large water treatment facility. These facilities produce mixed metal hydroxides that are generally buried in a landfill. Effluents from such facilities are salt laden by the very nature or the abatement process that typically uses sodium hydroxide and sulfuric acid as the basic chemicals for PH adjustment.

The object of the present invention is to provide for the treatment of the rinse water in an electroplating or processing line itself, and to avoid this mixing of many metal hydroxides with other contaminants in a large scale Pollution Abatement Facility where the treatment of such water becomes possible only by contaminating other elements of the environment.

SUMMARY OF THE INVENTION

This invention relates to an improvement in such a rinse tank where the normal input of fresh water is greatly reduced by reason of a parallel flow of circulating rinse water in a loop provided parallel to the conventional water flow. Treated water is continuously returned to one of the rinse tanks, preferably the rinse tank associated with the fresh water inlet supply. In accordance with the present invention a well is provided on one side of the downstream rinse tank in a counter flow rinse tank setup, and in this well a pump is provided to withdraw water from the rinse tank adjacent to the plating tank, and to pump this water through a series of canisters stacked preferably one on top of another so that the water passes through a series of ionized resin stations where an ion exchange process occurs in each canister to exchange hydrogen ions from the resin to the water in exchange for a metal ion from the water solution to the resin. The resin therefore accumulates the heavy metal from the plating process, and an important feature of the present invention is that this metal can be reclaimed as a result of the fact that the plating tank adjacent to the rinse tank equipped with a system of the present invention will have been plating only a single metal, or known metal alloy combination. The metal taken out of solution by the ionizing canisters will also be the same metal and will be in such form in the resin that it can be reclaimed. The water preferably moves from the lowermost canister to the uppermost canister where it is discharged and fed back to the cleaner of the two rinse tanks in a two compartment counter flow rinse tank setup.

DETAILED DESCRIPTION

In a conventional electroplating apparatus one or more preliminary treatment stations are provided so that the work can be moved through at least one plating station and through subsequent rinse stations in order that one or more heavy metals be provided on the workpieces in accordance with conventional technology. After each plating step or tank the workpieces must be rinsed in a rinsing tank or tanks so arranged that water must be provided continuously to these tanks in order that any excess metal be carried away with the rinse water and not cling to the workpieces so as to contaminate subsequent tanks in the processing steps provided. A typical counter flow type rinse tank has two rinse compartments divided by a partition and at least one compartment contains an overflow weir so that water can be introduced into one compartment and discharged over the weir to be introduced below the partition into the bottom of the adjacent compartment. In this manner relatively clean water is provided in the downstream or first compartment and the contaminated water withdrawn from the second compartment or tank. The second tank or compartment may include an overflow pipe that takes the water out of that compartment for discharge, usually to a common treating station where other rinse tank discharges are directed. This conventional rinsing process causes the hydroxides of heavy plating metals such as copper, zinc, lead or other metal hydroxides to be created at the Pollution Abatement Facility where very expensive waste treating process must be carried out to void contamination of the environment.

The present invention seeks to obviate the need for handling heavy metal hydroxides at such a common treating station, one positive result being that the Pollution Abatement Facility can be designed to more efficiently handle contaminates other than the heavy metal hydroxides.

A conventional flow through water system is provided, with clean water being introduced at 10 and thence into upstream rinse compartments C1 where this relatively clean water passes over a first weir W1 and downwardly between the weir and partition wall 12 where the water rises up into the second compartment C2 until reaching the level of weir W2 at which time the water will move outwardly through a discharge pipe 14. From the discharge pipe 14 the water must be piped to a conventional water treatment facility where the metal hydroxides are mixed with the hydroxides of other metals and with other contaminates, all of which must be disposed of by conventional technology. Once mixed one with another these contaminates create serious problems and present severe environmental hazards that can be much less severe if the advantages of the present invention are incorporated into a conventional electroplating and rinsing process.

Figure 1:
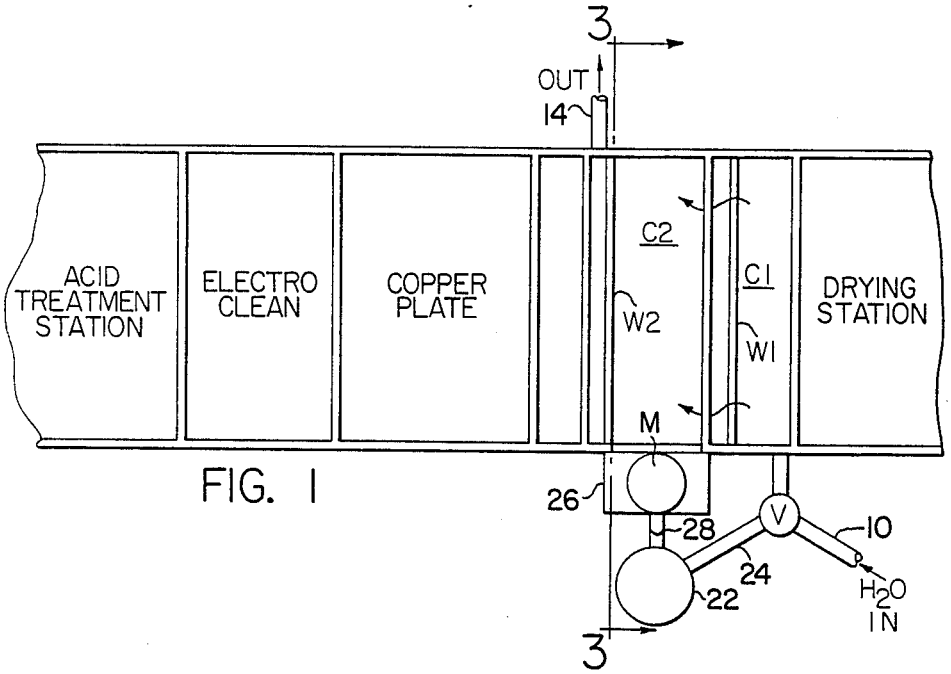
FIG. 1 is a plan view illustrating in schematic fashion an electroplating apparatus that includes a heavy metal plating station adjacent to which is provided a two-stage counter flow rinse tank or tanks. This view also shows a conventional counter flow rinse water system coupled with a parallel water treatment flow system in accordance with the present invention.
Figure 2:
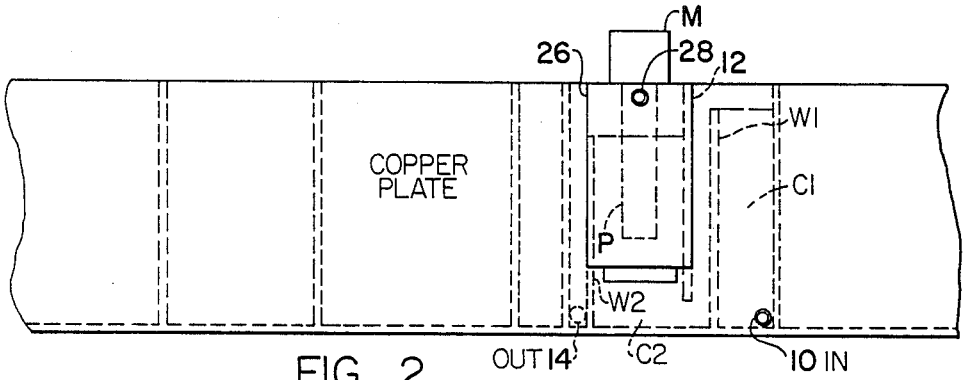
FIG. 2 is a side elevation of the apparatus illustrated in FIG. 1.

In accordance with the present invention a parallel water treatment systm is provided at the electroplating apparatus itself, said water treating apparatus including a group or stack of identical canisters 18, 20 and 22 that provide a simplified ion exchange system for removal of metals from rinse water. Each canister contains a quantity of absorbing resin material selected for a specific metal removal characteristics and water is pumped from the downstream rinse tank compartment C2 into the lowermost canister 18 and through that canister into another canister stacked above it where the water is ultimately discharged from an uppermost canister 22 as suggested by the line 24. This line 24 connects with the upstream rinse tank compartment C1, and this connection may be through a common line with the fresh water inlet as suggested in FIG. 1.

Figure 3:
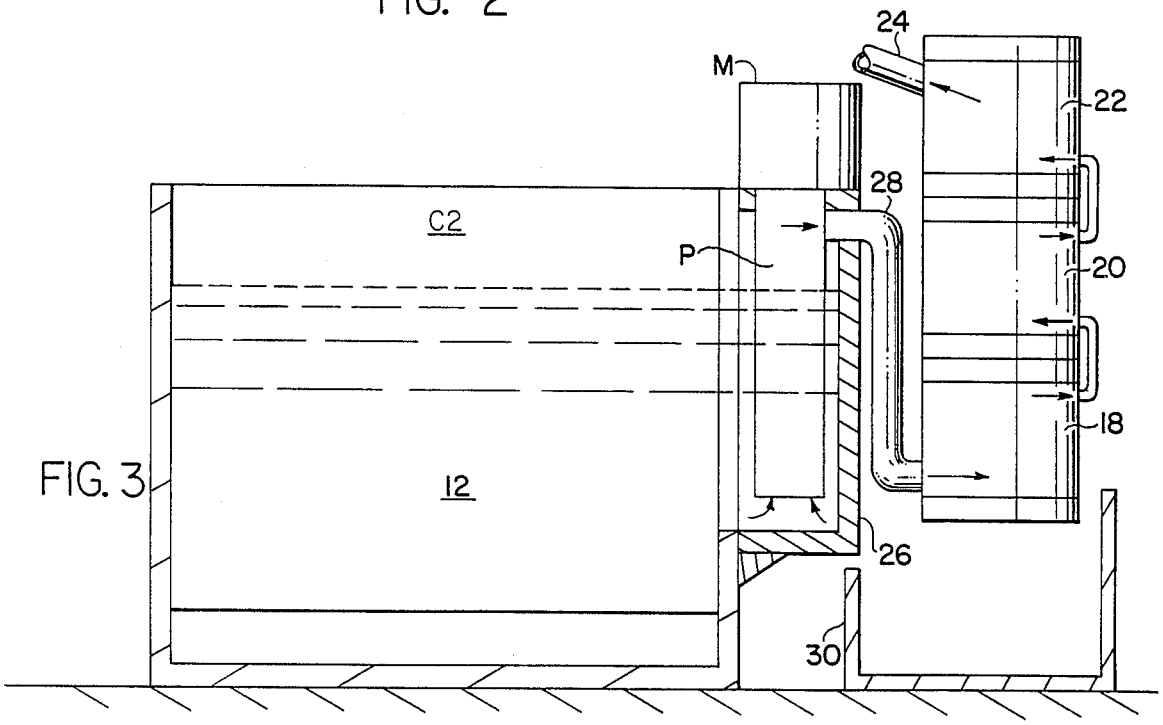
FIG. 3 is a vertical section taken generally on the line 3—3 of FIG. 1.

The rinse tank compartment C2 is provided with a laterally outwardly projecting tank extension or well that is designed to accommodate a submersible pump P and its associated motor M. This configuration provides minimum space for the motor and pump, and the output from the pump in line 28 is provided directly to the inlet end of the lowermost canister 18 as shown in FIG. 3. A reservoir 30 may be provided below the canisters 18, 20 and 22 in order to provide a convenient receptacle for draining these canisters when they are to be removed and replaced with new canisters or when they are to be rearranged, as for example by replacing the lowermost and dirtiest canister 22 with an upper canister and placing new canisters in place of the uppermost canisters 20 and/or 22.

The modular canister design for the ion exchange water treatment component of the system in accordance with the present invention permits any desired arrangement of cation/anion containing canisters to be employed with the desired type resin for a specific metal removal process. The canisters can be regenerated by conventional means so that the resin is rendered reuseable and the heavy metal recovered for reuse or other purpose. The present invention provides an environmentally acceptable method of recovering such metals without the necessity for accumulating many such metal hydroxides in a common receiving or treatment station where the metal hydroxides are ultimately not recovered in useable form and instead must be carried to a land fill or the like. It is estimated that 70–95% of all metal in the rinse water can be recovered for reuse or scrap as a result of incorporating an ion exchange type water treatment setup for the water rinse tank associated with each particular heavy metal plating tank in a typical electroplating apparatus.

As used herein the term electroplating is intended to encompass plating processes generally, that is wether the process is one of oxidation or reduction or a combination of these.

I claim:

1. In an electroplating apparatus having at least one plating station that includes at least one plating tank where workpieces are immersed in a metal bearing plating solution and said apparatus including at least one rinse tank where the plated workpieces are rinsed to remove metal bearing solution residue from the workpiece, the improvement to said rinse tank comprising water inlet means and water outlet means, said rinse tank including a portion defining a water pump receptacle, a water pump in said rinse tank receptacle, said water pump having an outlet, identical ion exchange canisters provided in series with one another and adjacent said water pump receptacle portion of said rinse tank, a first ion exchange canister in communication with said pump outlet to provide rinse tank water to said first ion exchange canister, a second ion exchange canister provided above said first canister and in comunication with the first for receiving partially treated rinse water for further treatment, and said inlet means also including means for returning the rinse water from said second ion exchange canister and for returning the further treated water to the rinse tank whereby a compact and self-contained rinse water treatment system is provided for said electroplating apparatus.

2. The combination of claim 1 wherein said rinse tank comprises at least two compartments, a weir in one compartment associated with the water inlet means, a partition between the two compartments and defining an opening to permit water passing over the weir to enter the second compartment.

3. The combination of claim 2 wherein said water pump is provided in said second rinse tank compartment.

* * * * *